US008696107B2

(12) United States Patent
Lo et al.

(10) Patent No.: US 8,696,107 B2
(45) Date of Patent: Apr. 15, 2014

(54) PRINT MEDIA JAM CLEARANCE ASSEMBLY

(75) Inventors: Kevin Lo, Vancouver, WA (US); Paul Coffin, Battle Ground, WA (US); Pierre J Kaiser, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 288 days.

(21) Appl. No.: 13/223,050

(22) Filed: Aug. 31, 2011

(65) Prior Publication Data

US 2013/0050372 A1 Feb. 28, 2013

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

| | | | | |
|---|---|---|---|---|
| 4,728,963 | A | 3/1988 | Rasmussen et al. | |
| 7,572,001 | B2 | 8/2009 | Ito | |
| 2007/0035605 | A1 | 2/2007 | Kitahara | |
| 2009/0141111 | A1 * | 6/2009 | Yamamoto | 347/104 |
| 2009/0279935 | A1 | 11/2009 | Kawaguchi | |

* cited by examiner

*Primary Examiner* — Matthew Luu
*Assistant Examiner* — Tracey McMillion

(57) ABSTRACT

Example embodiments disclosed herein relate to a print media jam clearance assembly for use in a printing device. The print media jam clearance assembly includes a first print medium jam clearance position and a second print medium jam clearance position. This is accomplished, in part, by a repositionable platen of the printing device.

24 Claims, 10 Drawing Sheets

PRINT MEDIA JAM CLEARANCE ASSEMBLY

BACKGROUND

A challenge exists to deliver quality and value to consumers, for example, by providing reliable printing devices that are cost effective. Further, businesses may desire to enhance the serviceability of their printing devices, for example, by allowing end users to easily maintain the components and performance of such printing devices.

BRIEF DESCRIPTION OF THE DRAWINGS

The following detailed description references the drawings, wherein.

DETAILED DESCRIPTION

Printing devices come in many different shapes and sizes. They can be used in a variety of applications and environments by consumers and other end users, such as the home, office, and commercial enterprises. Additionally, some printing devices produce output that is only monochrome, while others can produce color output as well. Printing devices can also have other features such as fax and copying capability or photo-quality output.

Printing devices should be reliable and relatively maintenance free. However, end-users may need to replace printing supplies such as print media (e.g., paper, transparencies, etc.), toner, and ink. End-users may also occasionally need to access the interior of a printing device to service components or fix certain malfunctions such as print media jams.

Figure 1:
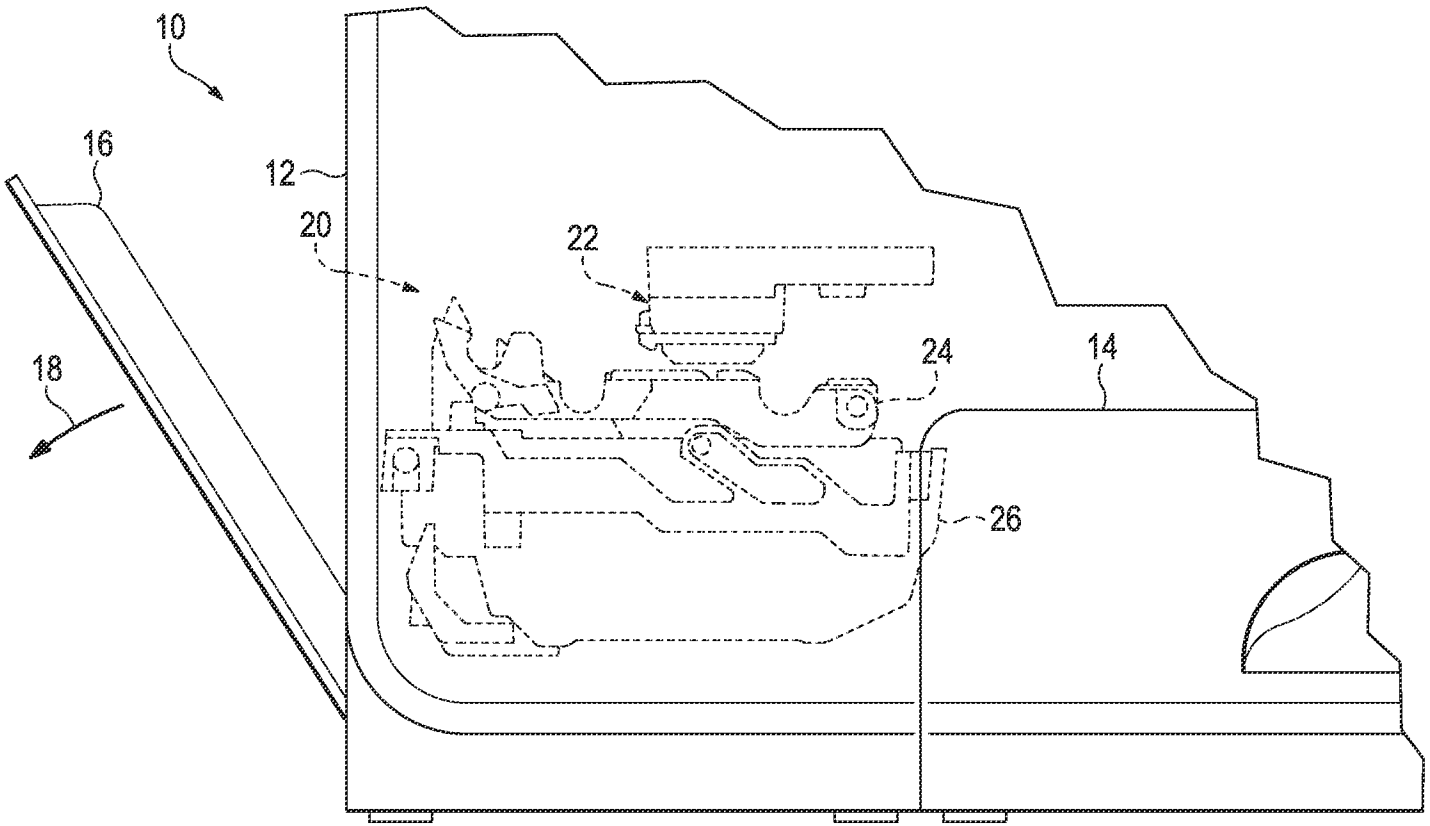
FIG. 1 is a fragmented view of an example of a printing device.

A fragmented view of a printing device 10 is shown in FIG. 1. Printing device 10 includes a housing or frame 12, a print media input tray 14 that stores a supply of print media (not shown), and an access door 16 that may be opened in the direction of arrow 18 to provide access to interior 20. Printing device 10 additionally includes a printing assembly 22, a platen 24, and a duplex mechanism 26 removably positioned on support member 28 (see FIG. 2), all of which are located in interior 20. It is to be understood that some components of printing device 10 are not shown in the fragmented view of FIG. 1, such as an output print media tray and a user interface.

Figure 2:
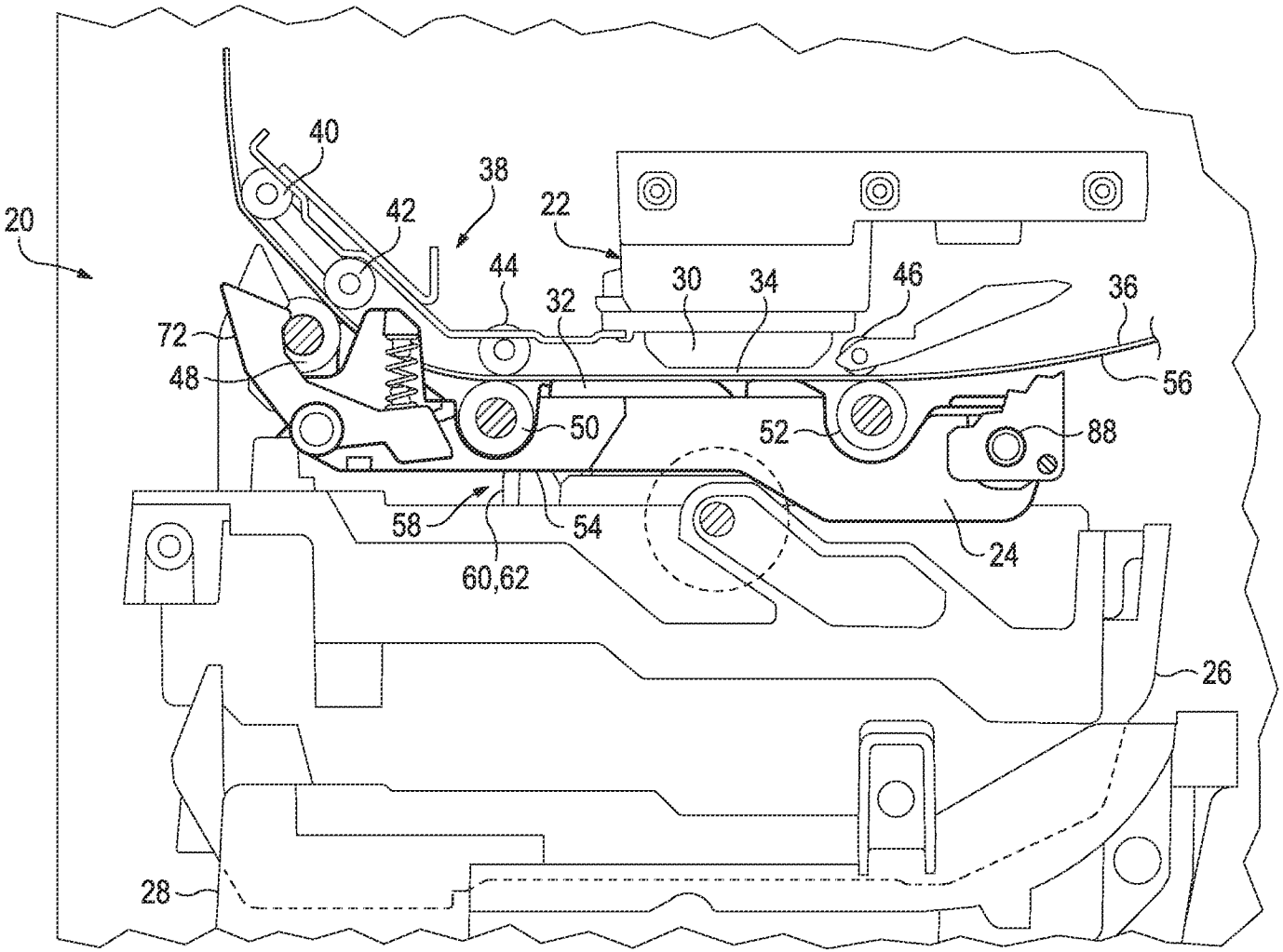
FIG. 2 shows an example of some of the interior components of the printing device of FIG. 1.

An example of some of the components located in interior 20 of printing device 10 is shown in FIG. 2. As can be seen in FIG. 2, printing assembly 22 includes an inkjet printhead 30 adjacent a first side 32 of platen 24. Printhead 30 and platen 24 together define a print zone 34 where ink from printhead 30 is deposited on print medium 36 as it is conveyed through print zone 34 by print media transport mechanism 38. Print media transport mechanism 38 includes a variety of components such as rollers 40, 42, 44, 46, 48, 50, and 52 one or more of which are driven by a motor (not shown) and controlled by a computing device (also not shown).

Platen 24 is designed to support and locate print medium 36 as it is conveyed by print media transport mechanism 38 through print zone 34. Platen 24 also includes a second side 54 located adjacent duplex mechanism 26. Duplex mechanism 26 is removably positioned in interior 20 of housing 12 on support member 28 and is configured to orient opposite side 56 of print medium 36 for conveyance by print media transport mechanism 38 through print zone 34. Duplex mechanism 26 includes a biasing assembly 58 that is configured to contact and apply a resilient force to second side 54 of platen 24 to aid in supporting and positioning platen 24 with respect to print zone 34. In the example shown in FIG. 2, biasing assembly 58 includes spring-loaded plungers 60 and 62.

Figure 3:
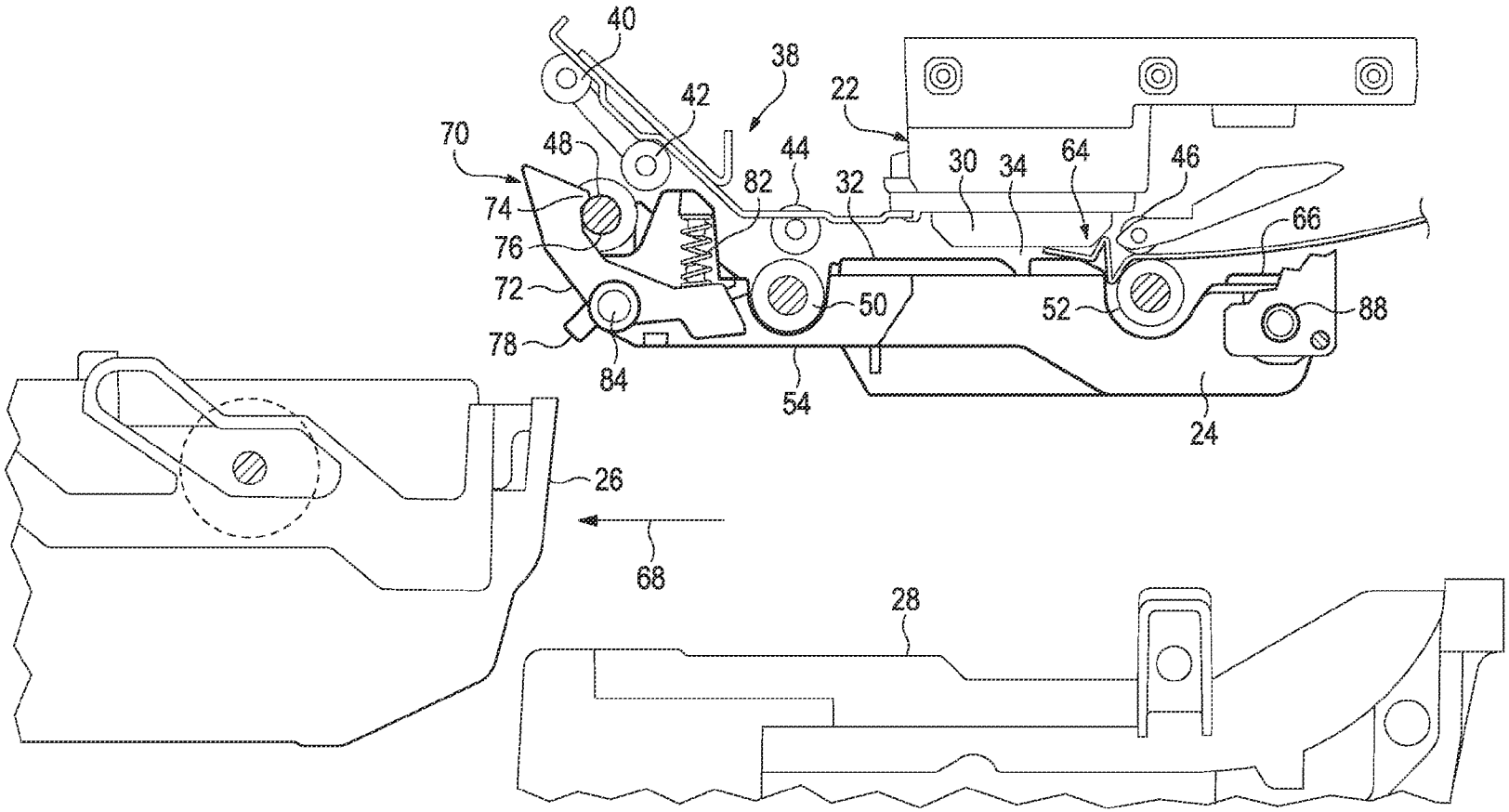
FIG. 3 illustrates an example of a print zone print medium jam.

As illustrated in FIG. 3 and briefly mentioned above, print media may occasionally jam or get caught in printing device 10 such that an end user must access interior 20 via access door 16 to manually clear it. At least two types of print media jams can occur in printing device 10. The first is a duplex mechanism 26 print medium jam and the other is a print zone 34 print medium jam. FIG. 3 illustrates an example of print zone 34 print medium jam 64, in this case one occurring near rollers 46 and 52 of print media transport mechanism 38.

The general location of a particular print medium jam within interior 20 of printing device 10 is determined by a sensor assembly 66 that includes a plurality of sensors which are positioned at various locations along the different paths traveled by print media. Sensor assembly 66 is connected to the computing unit (not shown) which is configured to determine the general location of a particular print medium jam (e.g., a duplex mechanism 26 print medium jam or a print zone 34 print medium jam) and display this information via a user interface (also not shown).

A duplex mechanism 26 print medium jam (not shown) can be cleared by manually removing duplex mechanism 26 from support member 28 of printing device 10 in the direction generally indicated by arrow 68. This allows an end user to access duplex mechanism 26 so the jammed print medium can be removed. Once this is done, the duplex mechanism 26 is replaced on support member 28 and access door 16 closed. Use of printing device 10 can then resume.

As can be seen in FIG. 3, a detent assembly 70 is configured to retain platen 24 in a first print medium jam clearance position upon removal of duplex mechanism 26. Detent assembly 70 includes a biased latch 72 (in this example in the form of a spring-loaded hook) configured to include a catch 74 that engages shaft 76 of roller 48 to retain platen 24 as shown.

Figure 4:
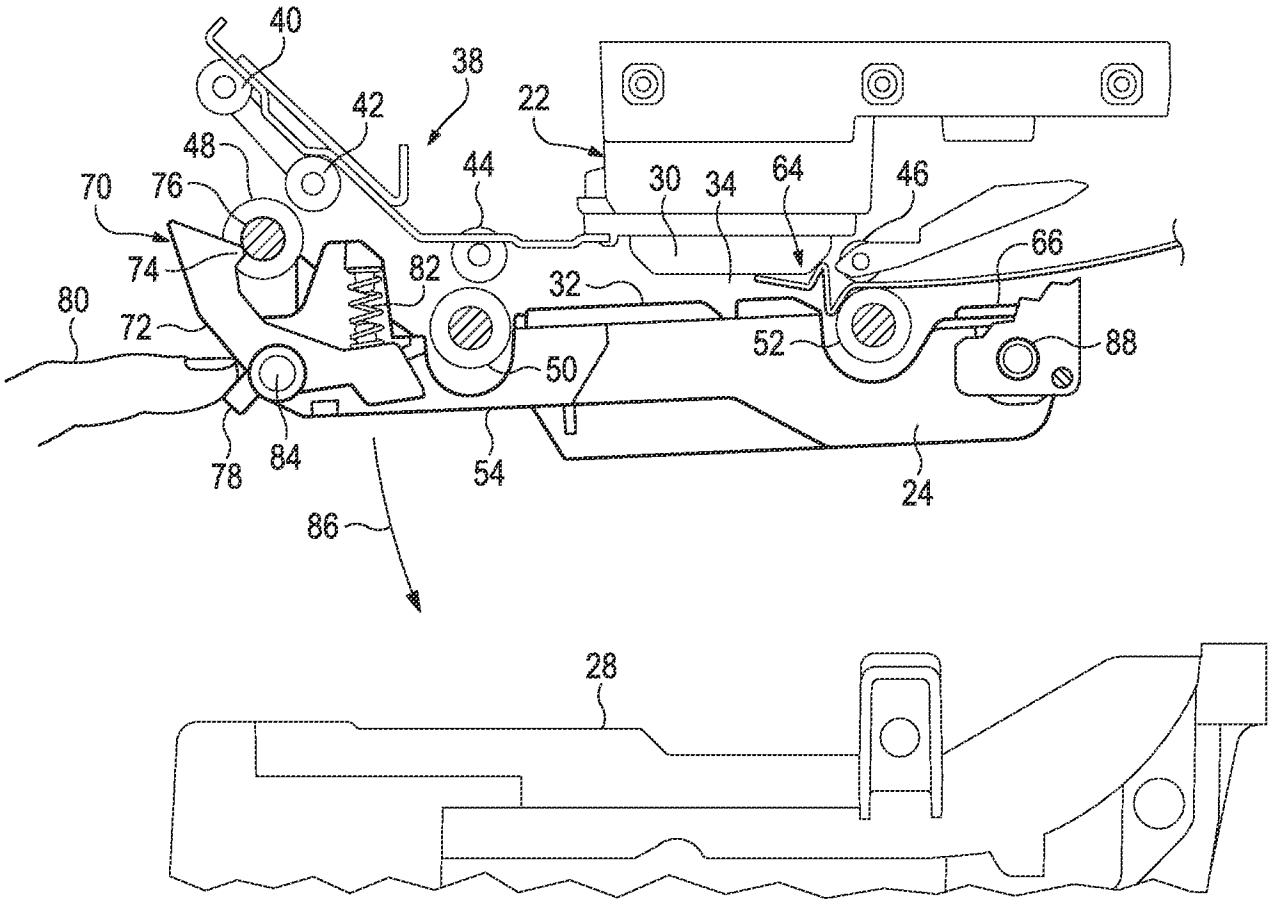
FIG. 4 illustrates an example of a first print medium jam clearance position.
Figure 5:
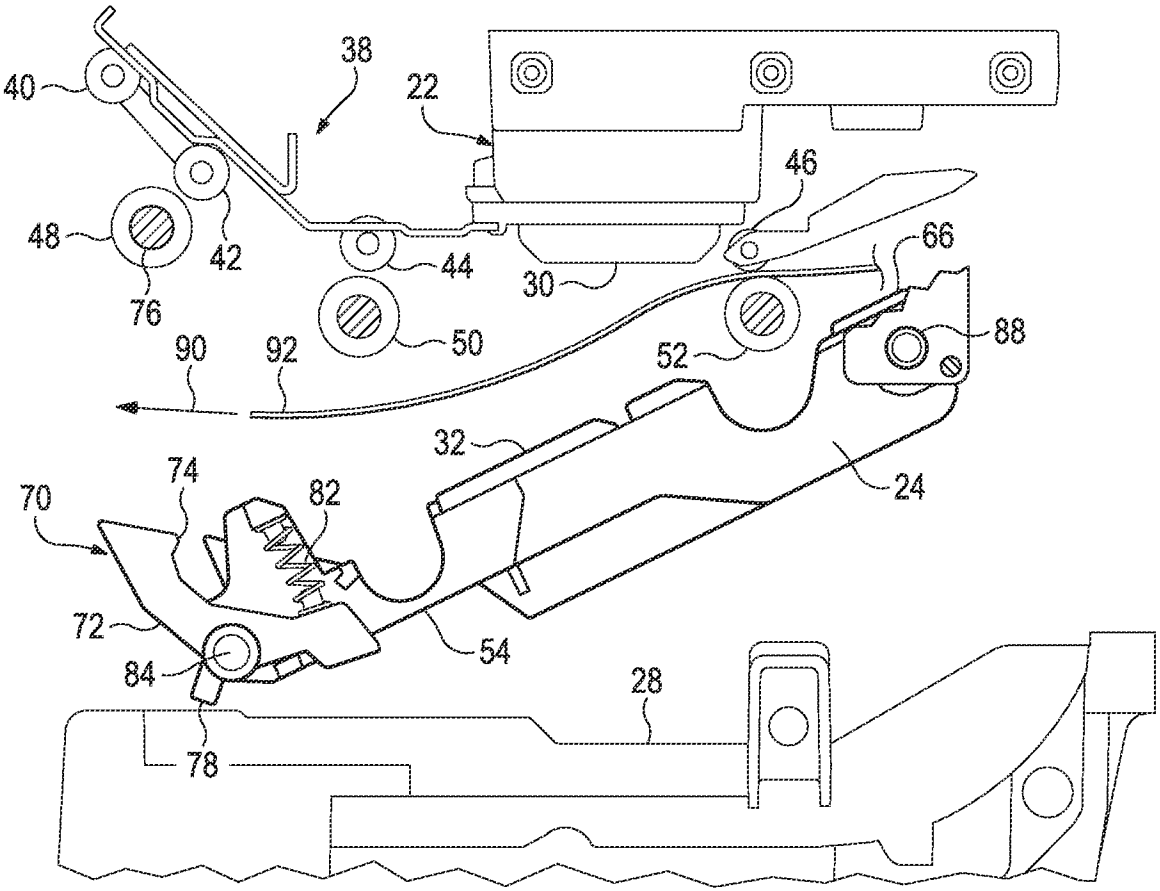
FIG. 5 illustrates an example of a second print medium jam clearance position.

As can be seen in FIG. 4, detent assembly 70 is additionally configured to include a manual release 78 that when moved by a finger 80 of an end user opposes the force applied by resilient member 82 (in this example a spring) which causes spring-loaded hook 72 to rotate about shaft 84 and compress this spring. This releases catch 74 from shaft 76 allowing platen 24 to move in the direction generally indicated by arrow 86 by rotating about axis or journal pin 88 so that platen 24 can assume a second print medium jam clearance position shown in FIG. 5. This allows print zone print medium jam 66 on first side 32 of platen 24 to be manually cleared and removed as generally indicated by arrow 90 and print odium 92 in FIG. 5. Platen 24 can then be rotated about journal pin 88 in a direction opposite that of arrow 86 so that catch 74 reengages shaft 76 and platen 24 is returned to the first print medium jam clearance position shown in FIG. 3. Duplex mechanism 26 may then be reinstalled on support member 28 to the position shown in FIG. 2 and access door 16 closed so that printing by printing device 10 may resume.

Figure 6:
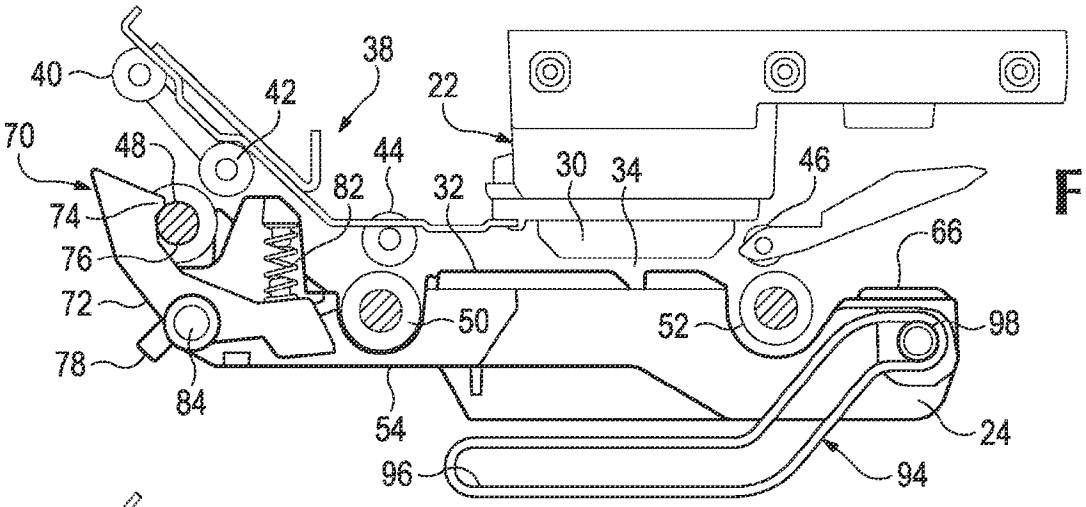
FIGS. 6 and 7 illustrate an example of an alternative arrangement for moving the platen of a printing device.
Figure 7:
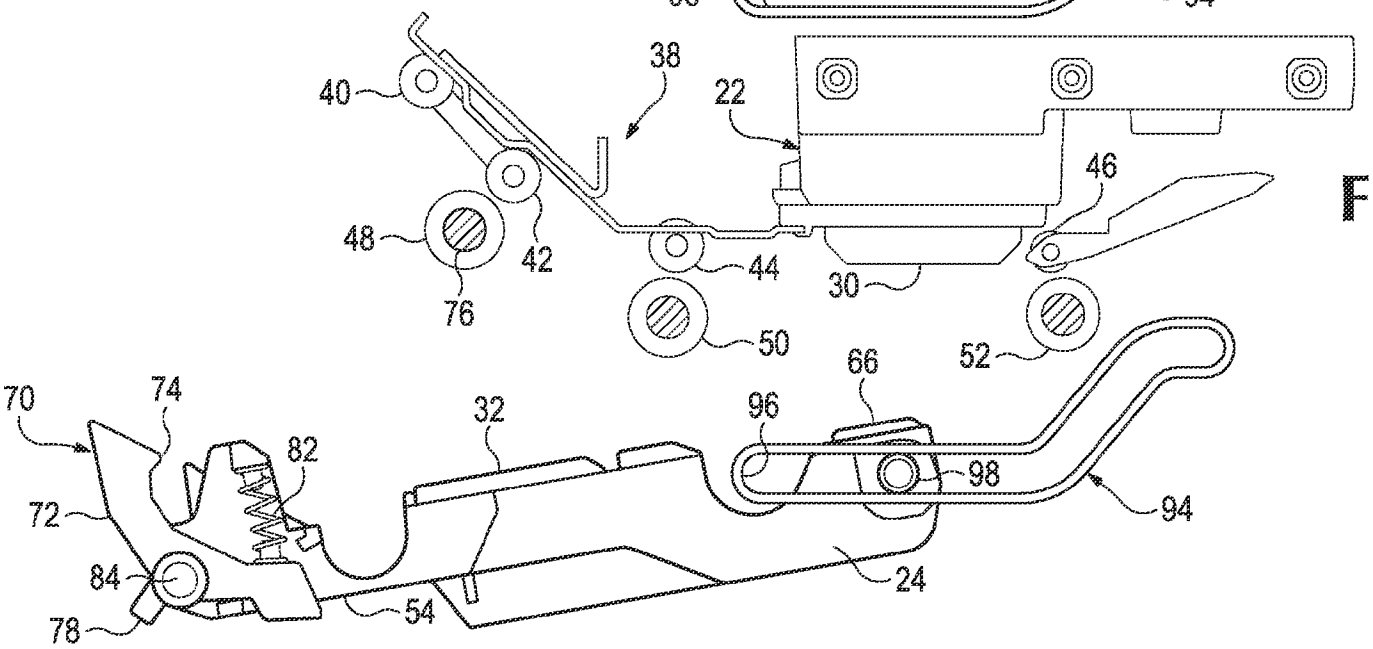

An alternative arrangement for moving platen 24 from the first print medium jam clearance position to the second print medium jam clearance position is illustrated FIGS. 6 and 7. More specifically, FIG. 6 shows platen 24 in the first print medium jam clearance position after duplex mechanism 26 has been removed from interior 20 of printing, device 10. A track 94 is coupled or otherwise attached to housing or frame 12 of printing device 10 on either side of platen 24. As can be seen in FIG. 6, track 94 is configured to include a channel 96 in which a pin 98 of platen 24 is disposed so that pin 98 can slide within channel 96. This arrangement allows platen 24 to be translated from the first print medium jam clearance position shown in FIG. 6 to the second print medium jam clearance position shown in FIG. 7.

Figure 8:
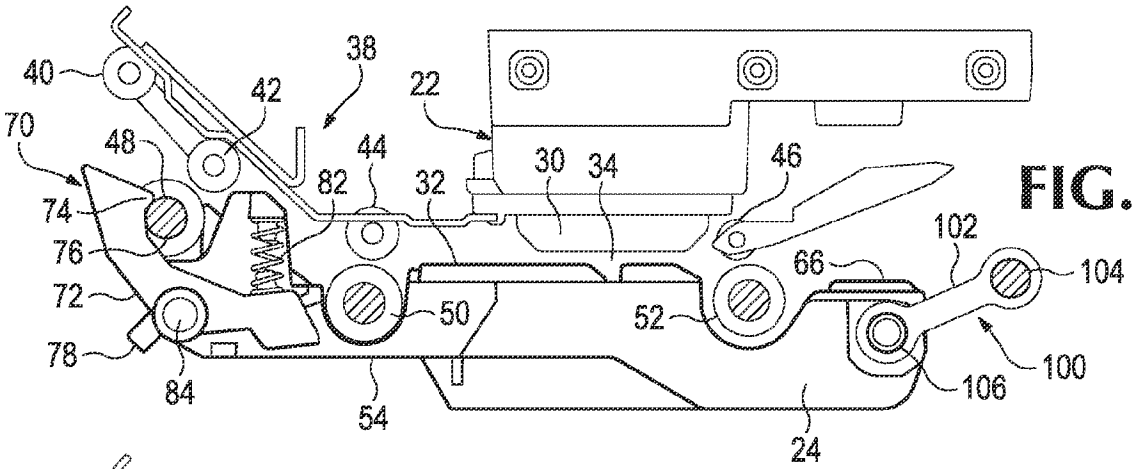
FIGS. 8 and 9 illustrate an example of another alternative arrangement for moving the platen of a printing device.
Figure 9:
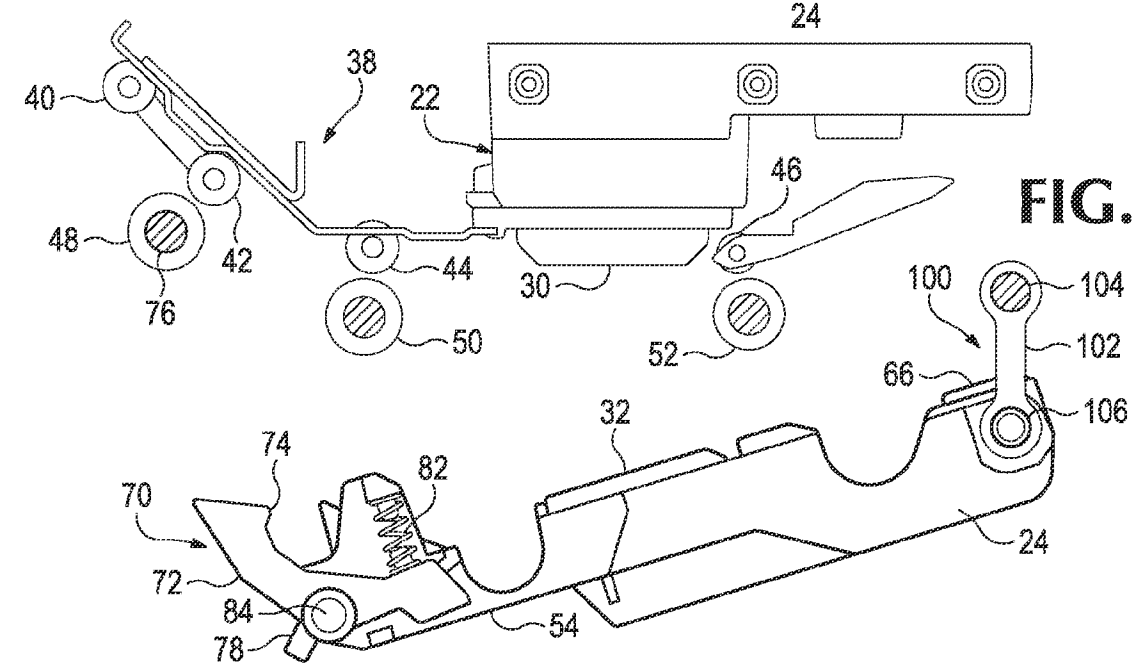

Another alternative arrangement for moving platen 24 from the first print medium jam clearance position to the second print medium jam clearance position is illustrated in FIGS. 8 and 9. More specifically, FIG. 8 shows platen 24 in the first print medium jam clearance position after duplex mechanism 26 has been removed from interior 20 of printing device 10. A double hinge assembly 100 is coupled or otherwise attached to housing or frame 12 of printing device 10 on either side of platen 24. As can be seen in FIG. 8, double hinge assembly 100 is configured to include an arm 102 rotatably coupled on one end to a first axis 104 and also rotatably coupled on an opposite second end to second axis 106. This arrangement allows platen 24 to be rotated from the first print medium jam clearance position shown in FIG. 8 to the second print medium jam clearance position shown in FIG. 9.

Figure 10:
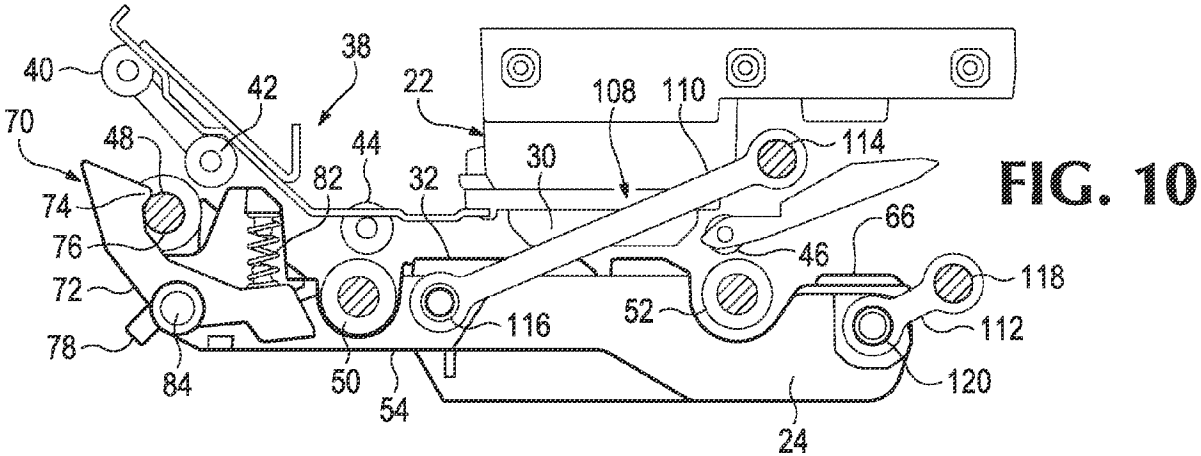
FIGS. 10 and 11 illustrate an example of a further alternative arrangement for moving the platen of a printing device.
Figure 11:
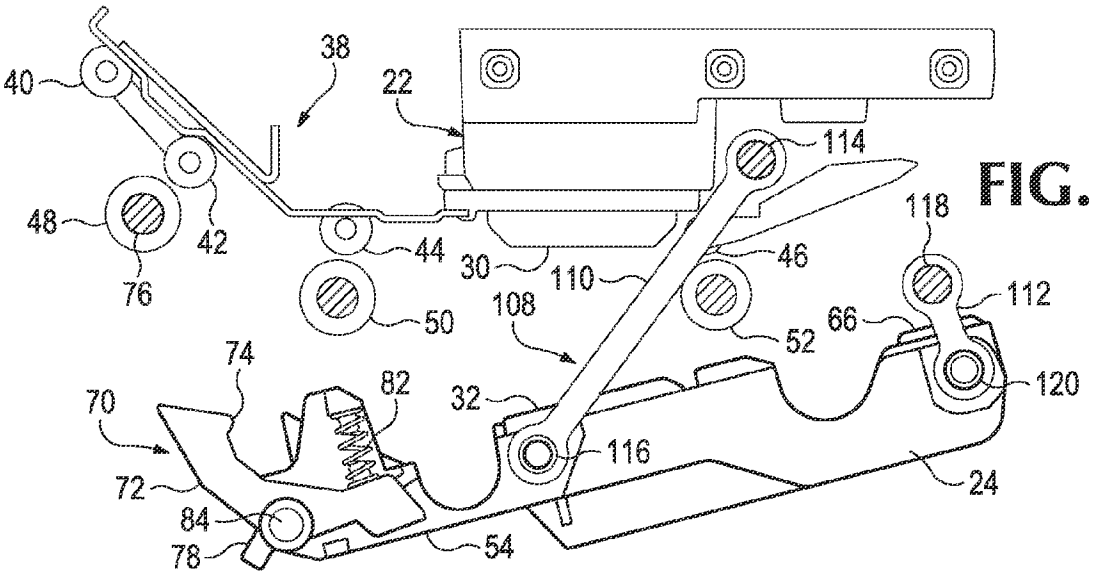

A further alternative arrangement for moving platen 24 from the first print medium jam clearance position to the second print medium jam clearance position is illustrated in FIGS. 10 and 11. More specifically, FIG. 10 shows platen 24 in the first print medium jam clearance position after duplex mechanism 26 has been removed from interior 20 of printing device 10. A parallelogram hinge assembly 108 is coupled or otherwise attached to housing or frame 12 of printing device 10 on either side of platen 24. As can be seen in FIG. 10, parallelogram hinge assembly 108 is configured to include a pair of uneven arms 110 and 112 of different lengths. Arm 110 is rotatably coupled on one end to a first axis 114 and also rotatably coupled on an opposite second end to second axis 116. Arm 112 is rotatably coupled on one end to a third axis 118 and on a second end to a fourth axis 120. This arrangement allows platen 24 to be rotated from the first print medium jam clearance position shown in FIG. 10 to the second print medium jam clearance position shown in FIG. 11.

Figure 12:
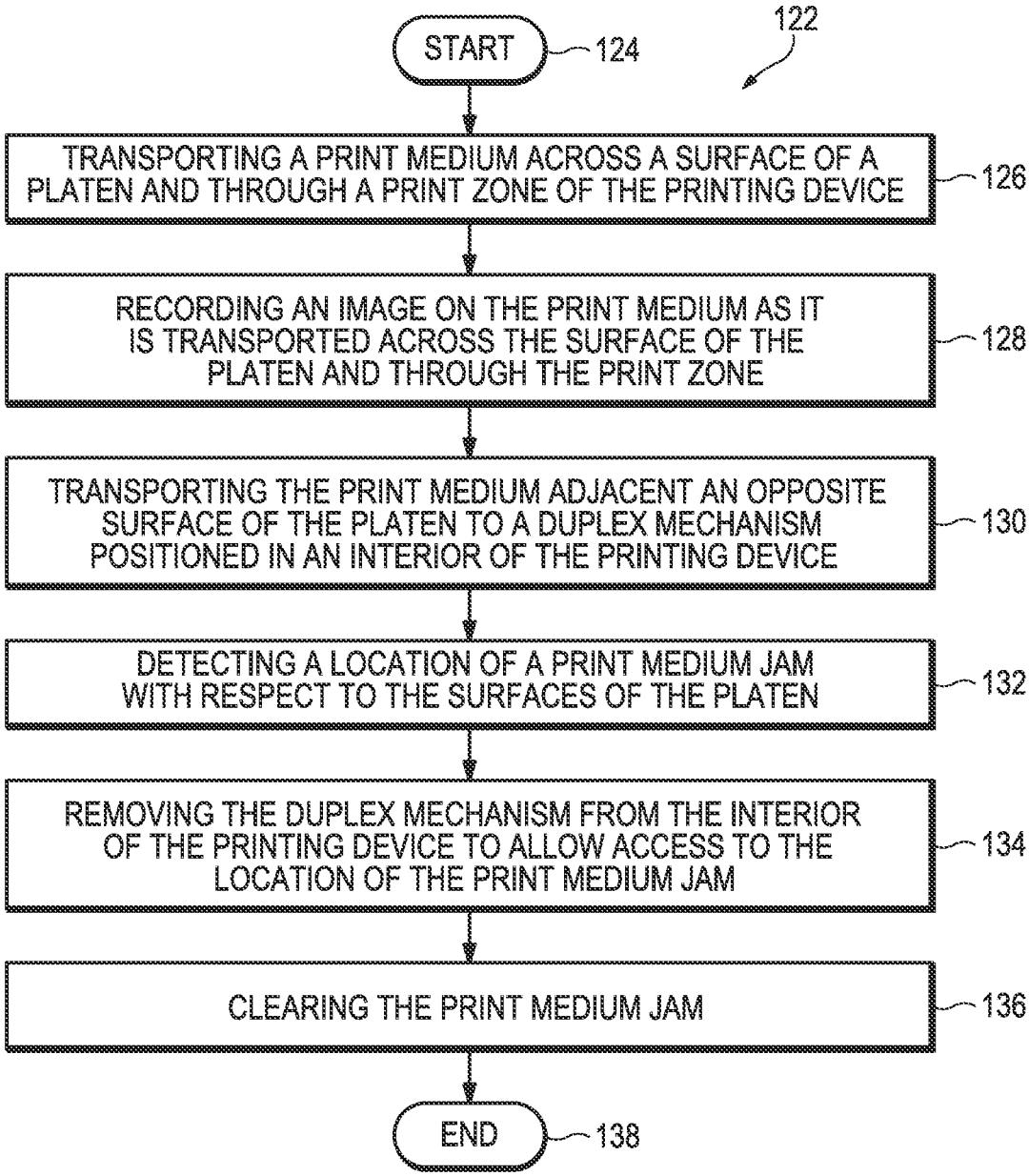
FIG. 12 is an example of a method for clearing print media jams occurring in a printing device.

An example of a method 122 for clearing print media jams occurring in a printing device is shown in FIG. 12. As shown in FIG. 12, method 122 starts 124 by transporting a print medium across a surface of a platen and through a print zone of the printing device, as generally illustrated by block 126, and recording an image on the print medium as it is transported across the surface of the platen and through the print zone, as generally illustrated by block 128. Method 122 next transports the print medium adjacent an opposite surface of the platen to a duplex mechanism positioned in an interior of the printing device, as generally shown by block 130, and detects a location of a print medium jam with respect to the surfaces of the platen, as generally shown by block 132. As also shown in FIG. 12, method 122 then removes the duplex mechanism from the interior of the printing device to allow access to the location of the print medium jam, as generally illustrated by block 134, and clears the print medium jam, as generally illustrated by block 136. Method 122 may then end 138.

Figure 13:
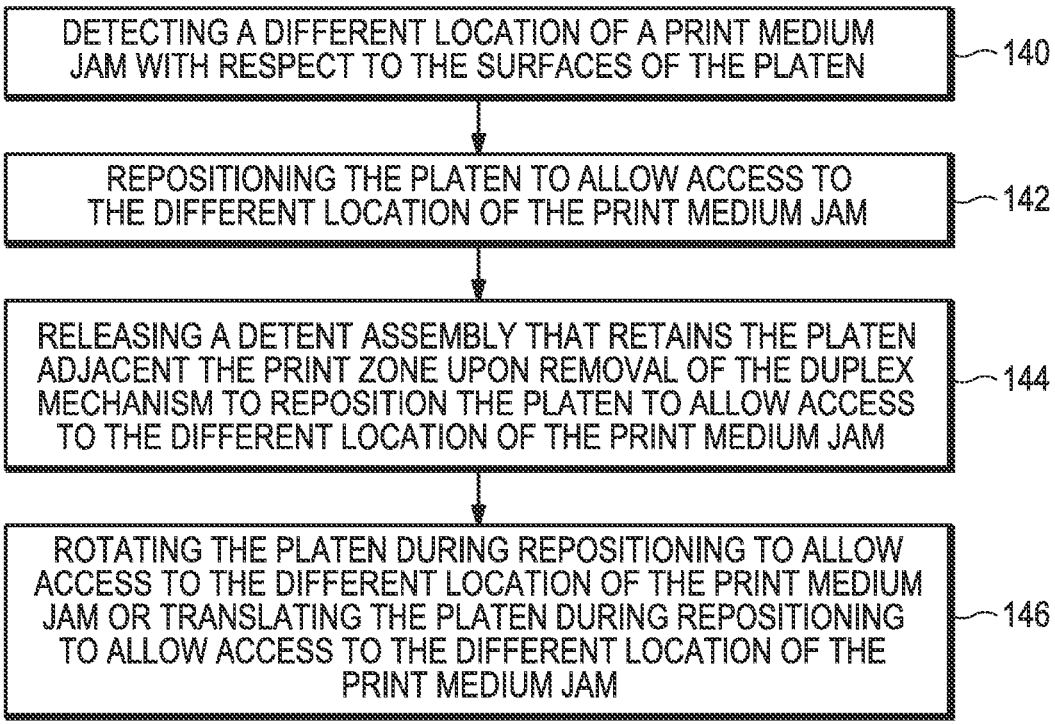
FIG. 13 is an example of additional elements of the method shown in FIG. 12.

As shown in FIG. 13, method 122 may include additional elements to those illustrated in FIG. 12. For example, method 122 may also include detecting a different location of a print medium jam with respect to the surfaces of the platen, as generally shown by block 140 in FIG. 13, and repositioning the platen to allow access to the different location of the print medium jam, as generally indicated by block 142. Method 122 may additionally include releasing a detent assembly that retains the platen adjacent the print zone upon removal of the duplex mechanism to reposition the platen to allow access to the different location of the print medium jam, as generally indicated by block 144. Method 122 may further include rotating the platen during repositioning to allow access to the different location of the print medium jam or translating the platen during repositioning to allow access to the different location of the print medium jam, as generally indicated by block 146.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A printing device, comprising:

a housing having an interior;

a printing assembly configured to deposit printing composition on a print medium in a print zone located in the interior of the housing;

a print media transport mechanism configured to convey the print medium through the print zone;

a duplex mechanism removably positioned in the interior of the housing and configured to orient an opposite side of the print medium for conveyance by the print media transport mechanism through the print zone;

a platen configured both to support the print medium in the print zone and to have a first position designed to allow access to the interior of the housing for manual clearing of duplex mechanism print medium jams and a second position designed to allow access to the interior of the housing for manual clearing of print zone print medium jams; and a biasing assembly coupled to the duplex mechanism and configured to contact the platen thereby aiding in positioning of the platen with respect to the print zone.

2. The printing device of claim 1, wherein the biasing assembly includes a spring-loaded plunger.

3. The printing device of claim 1, further comprising a detent assembly configured to retain the platen in the first position upon removal of the duplex mechanism from the interior of the housing.

4. The printing device of claim 3, wherein the detent assembly is further configured to include a manual release that allows the platen to assume the second position.

5. The printing device of claim 3, wherein the detent assembly includes a spring-loaded hook.

6. The printing device of claim 1, wherein the print zone print medium jams are located on a first side of the platen adjacent the print zone and the duplex mechanism print medium jams are located on a second side of the platen adjacent the duplex mechanism.

7. The printing device of claim 1, wherein the platen is further configured to rotate from the first position to the second position.

8. The printing device of claim 1, wherein the platen is further configured to translate from the first position to the second position.

9. The printing device of claim 1, further comprising a sensor assembly configured to detect one of a duplex mechanism print medium jam and a print zone print medium jam.

10. The printing device of claim 1, further comprising a track coupled to the housing and platen, and configured to translate the platen from the first position to the second position.

11. The printing device of claim 1, further comprising a double hinge assembly coupled to the housing and platen, and configured to rotate the platen about a first axis and a second axis between the first position and the second position.

12. The printing device of claim 1, further comprising a parallelogram hinge assembly coupled to the housing and platen, and configured to rotate the platen between the first position and the second position.

13. A print media jam clearance assembly for use in a printing device, comprising:

a platen configured both to have a first print medium jam clearance position on a second side of the platen and a second print medium jam clearance position on a first side of the platen;

a detent assembly configured both to retain the platen in the first print medium jam clearance position and to include a manual release that allows the platen to assume the second print medium jam clearance position; and a sensor configured to detect one of a print medium jam adjacent the first side of the platen and a print medium jam adjacent the second side of the platen.

14. The print media jam clearance assembly of claim 13, further comprising a duplex mechanism removably positioned adjacent the second side of the platen and configured to include a biasing assembly configured to contact the second side of the platen to help position the first side of the platen adjacent a print zone of the printer.

15. The print media jam clearance assembly of claim 13, wherein the detent assembly includes a spring-loaded hook.

16. The print media jam clearance assembly of claim 13, wherein the platen is further configured to rotate from the first print medium jam clearance position to the second print medium jam clearance position.

17. The print media jam clearance assembly of claim 13, wherein the platen is further configured to translate from the first print medium jam clearance position to the second print medium jam clearance position.

18. The print media jam clearance assembly of claim 13, further comprising a track coupled to a frame of the printing device and platen, and configured to translate the platen from the first print medium jam clearance position to the second print medium jam clearance position.

19. The print media jam clearance assembly of claim 13, further comprising a double hinge assembly coupled to a frame of the printing device and platen, and configured to rotate the platen about a first axis and a second axis between the first print medium jam clearance position to the second print medium jam clearance position.

20. The print media jam clearance assembly of claim 13, further comprising a parallelogram hinge assembly coupled to a frame of the printing device and platen, and configured to rotate the platen between the first print medium jam clearance position to the second print medium jam clearance position.

21. A method for clearing print media jams occurring in a printing device, comprising:

transporting a print medium across a surface of a platen and through a print zone of the printing device;

recording an image on the print medium as it is transported across the surface of the platen and through the print zone;

transporting the print medium adjacent an opposite surface of the platen to a duplex mechanism positioned in an interior of the printing device;

detecting a location of a print medium jam with respect to the surfaces of the platen;

removing the duplex mechanism from the interior of the printing device to allow access to the location of the print medium jam;

detecting a different location of the print medium jam with respect to the surfaces of the platen;

repositioning the platen to allow access to the different location of the print medium jam; and clearing the print medium jam.

22. The method for clearing print media jams of claim 21, further comprising releasing a detent assembly that retains the platen adjacent the print zone upon removal of the duplex mechanism to reposition the platen to allow access to the different location of the print medium jam.

23. The method for clearing print media jams of claim 21, further comprising rotating the platen during repositioning to allow access to the different location of the print medium jam.

24. The method for clearing print media jams of claim 21, further comprising translating the platen during repositioning to allow access to the different location of the print medium jam.

* * * * *